US007604059B2

(12) United States Patent
Thornton

(10) Patent No.: US 7,604,059 B2
(45) **Date of Patent: *Oct. 20, 2009**

(54) DOWNHOLE TOOLS

(75) Inventor: John Thomas Oliver Thornton, Aberdeen (GB)

(73) Assignee: Brunel Oilfield Services (UK) Limited, Dyce, Aberdeen (GB)

( * ) Notice: Subject to any disclaimer, the term of this patent is extended or adjusted under 35 U.S.C. 154(b) by 0 days.

This patent is subject to a terminal disclaimer.

(21) Appl. No.: 12/047,795

(22) Filed: Mar. 13, 2008

(65) Prior Publication Data

US 2008/0156488 A1 Jul. 3, 2008

Related U.S. Application Data

(63) Continuation of application No. 10/312,605, filed as application No. PCT/GB01/02855 on Jun. 28, 2001, now Pat. No. 7,357,178.

(30) Foreign Application Priority Data

Jun. 30, 2000 (GB) ..... 0016145.5

(51) Int. Cl.
*E21B 17/00* (2006.01)

(52) U.S. Cl. ..... 166/381; 166/241.6; 166/278; 175/325.5

(58) Field of Classification Search ..... 166/241.1, 166/241.6, 381, 278; 175/325.1, 325.5
See application file for complete search history.

(56) References Cited

U.S. PATENT DOCUMENTS

| | | | |
|---|---|---|---|
| 2,368,415 | A | 1/1945 | Grant |
| 2,715,552 | A | 8/1955 | Lane |
| 3,080,926 | A | 3/1963 | Remp, Jr. |
| 3,268,275 | A | 8/1966 | Laughlin |
| 3,981,359 | A | 9/1976 | Fortenberry |
| 4,334,834 | A | 6/1982 | Werner et al. |
| 4,399,865 | A | 8/1983 | Anderson et al. |
| 4,796,670 | A | 1/1989 | Russell et al. |
| 4,938,299 | A | 7/1990 | Jelsma |
| 5,692,562 | A | 12/1997 | Squires |
| 5,833,018 | A | 11/1998 | Von Gynz-Rekowski |
| 6,032,748 | A | 3/2000 | DeBray et al. |

(Continued)

FOREIGN PATENT DOCUMENTS

| | | | |
|---|---|---|---|
| GB | 2 221 225 | A | 6/1989 |

(Continued)

OTHER PUBLICATIONS

International Search Report for PCT/GB01/02855, completed Sep. 5, 2001.

*Primary Examiner*—Shane Bomar
(74) *Attorney, Agent, or Firm*—Alston & Bird LLP

(57) ABSTRACT

An improved centralizer is provided for centralization of tubulars such as casings, liners, production tubing, and production screens, in oil/gas wells. Such a centralizer comprises a tubular body, wherein a portion of an outermost surface of the tubular body is formed from a first material, and a portion of, or portion adjacent to, at least one end of the tubular body, and/or a portion of an innermost surface of the tubular body, is formed from at least one second material, in contrast to unitary construction centralizers disclosed by the prior art, and the first material has a lower Young's modulus than the at least one second material.

50 Claims, 13 Drawing Sheets

U.S. PATENT DOCUMENTS

| | | | | |
|---|---|---|---|---|
| 6,435,275 | B1 | 8/2002 | Kirk et al. | |
| 6,666,267 | B1 | 12/2003 | Charlton | |
| 7,357,178 | B2 * | 4/2008 | Thornton | 166/241.6 |

FOREIGN PATENT DOCUMENTS

| | | | |
|---|---|---|---|
| GB | 2 358 418 | A | 7/2001 |
| GB | 2 381 815 | B | 12/2004 |
| GB | 2 381 284 | B | 1/2006 |
| WO | WO 98/37302 | A | 8/1998 |
| WO | WO 99/25949 | A2 | 5/1999 |
| WO | WO 02/02904 | A1 | 1/2002 |

* cited by examiner

FIG. 1 - Prior Art

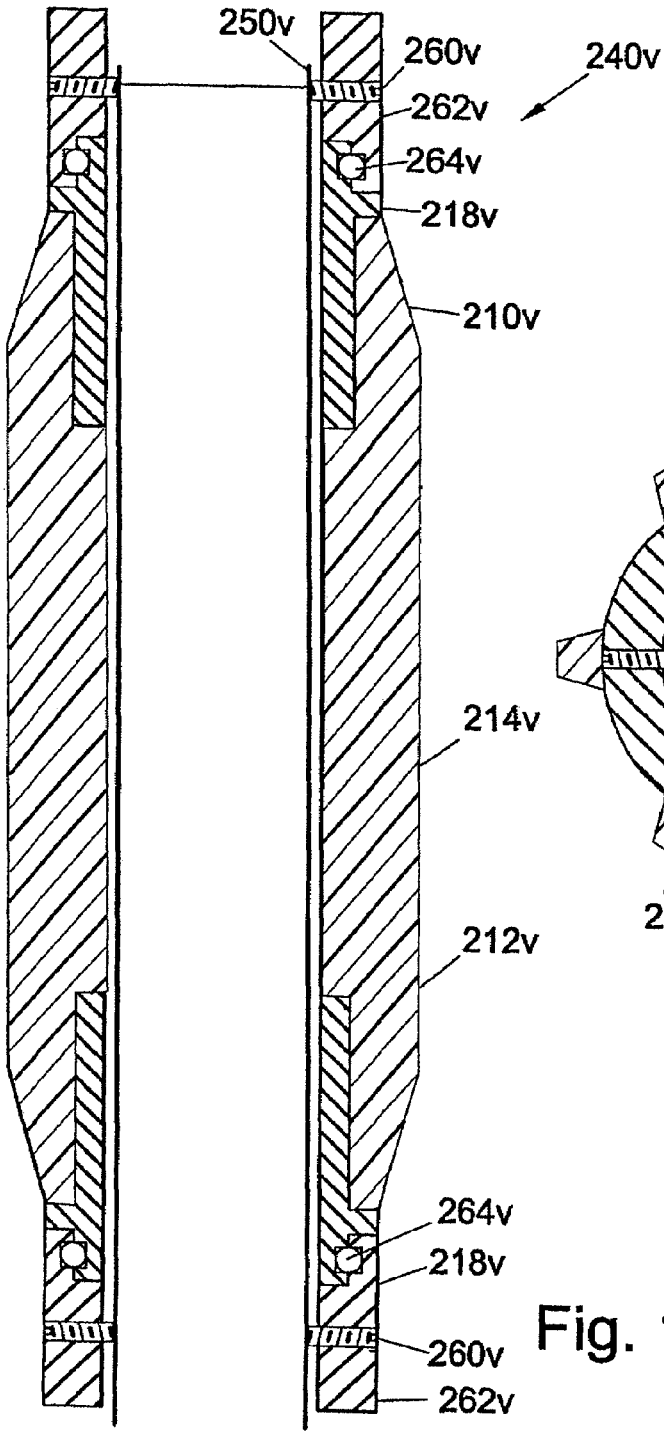
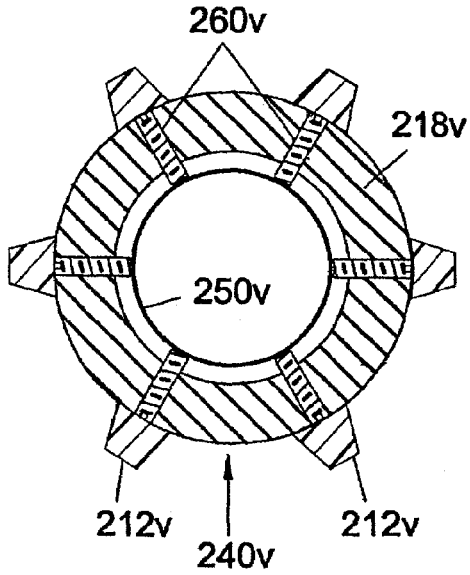
Fig. 16(b)
Fig. 16(a)

DOWNHOLE TOOLS

CROSS-REFERENCE TO RELATED APPLICATIONS

This application is a continuation of U.S. Pat. No. 7,357,178, issued Apr. 15, 2008, which was filed Jan. 30, 2003 as U.S. application Ser. No. 10/312,605, which was a national stage filing under 35 U.S.C. 371 of PCT/GB01/02855, filed Jun. 28, 2001, which International Application was published by the International Bureau in English on Jan. 10, 2002, and claims priority to British Application No. 0016145.5, filed Jun. 30, 2000, all which are hereby incorporated herein in their entirety by reference.

FIELD OF INVENTION

This invention relates to downhole tools; particularly, though not exclusively, the invention relates to an improved centraliser for centralisation of tubulars such as casings, liners, production tubing, production screens and the like, in oil/gas wells.

BACKGROUND TO INVENTION

As a borehole is drilled it is necessary to secure the borehole walls to prevent collapsing and to provide a mechanical barrier to wellbore fluid ingress and drilling fluid egress. This is achieved by cementing in casings. Casings are tubular sections positioned in the borehole, and the annular space between the outer surface of the casing and the borehole wall is conventionally filled with a cement slurry.

After the well has been drilled to its final depth it is necessary to secure a final borehole section. This is performed by either leaving the final borehole section open (termed an open hole completion), or by lining the final borehole section with a tubular such as a liner (hung off the previous casing) or casing (extending to the surface), whereby the annular space between the liner or casing and the borehole is filled with a cement slurry (termed a cased hole completion).

The production tubing is then run into the lined hole and is secured at the bottom of the well with a sealing device termed a "packer" that seals the annulus so formed between this production tubing and the outer casing or liner. At the top of the well the production tubing is fixed to a wellhead/christmas tree combination. This production tubing is used to evacuate the hydrocarbon.

In some instances instead of running a final liner string, the final borehole section is left open and screens are run. Screens are typically perforated production tubing having either slits or holes. These screens once in position act as a conduit in a procedure to fill the annular void between the borehole wall and the screen by placing sand around the screen. The sand acts as a filter and as a support to the borehole wall. The term used for this operation is "gravel packing".

In each case centralising a tubular within a borehole or within another tubular is necessary to ensure tubulars do not strike or stick against the borehole wall or wall of the other tubular, and that a substantially exact matching of consecutive tubulars positioned in the borehole is achieved, while allowing for an even distribution of materials, ie cement or sand, placed within the annulus formed.

Centralisers for drill-strings used to aid in the directing of a drill bit within a borehole are documented. More recently casing centralisers have been described which aim to keep the casing away from the borehole wall and/or aid the distribution of cement slurry in the annulus between the outer surface of the casing and the borehole wall. Examples of casing centralisers are:

U.S. Pat. No. 5,085,981 (MIKOLAJCZYK) discloses a casing centraliser comprising a circumferentially continuous tubular metal body adapted to fit closely about a joint of casing, and a plurality of solid metal blades fixed to the body and extending parallel to the axis of the body along the outer diameter of the body in generally equally spaced apart relation, each blade having opposite ends which are tapered outwardly toward one another and a relatively wide outer surface for bearing against the well-bore or an outer casing in which the casing is disposed, including screws extending threadedly through holes in at least certain of the blades and the body for gripping the casing so as to hold the centraliser in place.

EP 0 671 546 A1 (DOWNHOLE PRODUCTS) discloses a casing centraliser comprising an annular body, a substantially cylindrical bore extending longitudinally through said body, and a peripheral array of a plurality of longitudinally extending blades circumferentially distributed around said body to define a flow path between each circumferentially adjacent pair of said blades, each said flow, path providing a fluid flow path between longitudinally opposite ends of said centraliser, each said blade having a radial outer edge providing a wellbore contacting surface, and said cylindrical bore through said body being a clearance fit around casing intended to be centralised by said casing centraliser, the centraliser being manufactured wholly from a material which comprises zinc or a zinc alloy.

WO 98/37302 (DOWNHOLE PRODUCTS) discloses a casing centraliser assembly comprising a length of tubular casing and a centraliser of unitary construction (that is, made in one piece of a single material and without any reinforcement means) disposed on an outer surface of the casing, the centraliser having an annular body, and a substantially cylindrical bore extending longitudinally through the body, the bore being a clearance fit around the length of the tubular casing, characterised in that the centraliser comprises a plastic, elastomeric and/or rubber material.

WO 99/25949 to the present applicant also discloses an improved casing centraliser.

The content of the above-mentioned prior art documents are incorporated herein by reference.

As is apparent from the art, many centralisers have been developed to overcome known problems of centralising a tubular and distributing an annulus material. These centralisers are of unitary assembly and are made of a plastic, or more generally, a material such as zinc, steel or aluminium. However, in selecting a single material a trade-off must be made as:

(a) the chosen material must provide a low friction surface against the smooth tubular outermost surface while being strong enough to withstand abrasion from rugeous borehole walls;

(b) the chosen material must act as a journal bearing once the centraliser is in its downhole location, but during the running operation it must act as a thrust bearing.

Material such as plastic deforms, and may potentially ride over stop rings or casing collars. This may occur when the centraliser contacts ledges (possibly the ledges within the BOP stack cavities and wellhead) when run in a cased hole, or to ledges and rugous boreholes when run in open hole. The centraliser is driven along the tubular in the opposite axial direction to that of the tubular motion and is driven into the rings and/or collars. Additionally, when the tubular is rotated (a common procedure when running tubular downhole, converting drag friction to torque friction) the "nose" of the centraliser is forced against a stop-collar and the tubular rotated thus causing the centraliser nose to act as a thrust bearing. If the centraliser deforms and rides over the collar, the stretched material may jam the centraliser, and possibly the tool or assembly against the borehole wall. This is illustrated in cross-section in FIG. 1, where centraliser 110 lies between tubular 140 being centralised within borehole 152. Centraliser 110 of centralising apparatus 140 has been caused to stretch over stop collar 144 and as a result jammed outermost surface 112 of centraliser 110 against borehole wall 152.

It is an object of at least one embodiment of the present invention to obviate or at least mitigate at least one of the aforementioned disadvantages.

SUMMARY OF INVENTION

According to a first aspect of the present invention there is provided a centraliser comprising a tubular body, a portion of an outermost surface of said tubular body being formed substantially from a first material and a portion of or adjacent to at least one end of said tubular body being formed substantially from a second material, the first material having a lower Youngs modulus or modulus of elasticity than the second material.

According to a second aspect of the present invention there is provided a centraliser comprising a tubular body, a portion of an outermost surface of said tubular body being formed substantially from a first material and a portion of an innermost surface of said tubular body being formed substantially from a second material, the first material having a lower Youngs modulus than the second material.

The centralisers of the first and second aspects may therefore be termed "composite" centralisers. These centralisers are therefore "non-unitary" in construction, that is to say, they are not formed in one piece from one material. They do however, offer a centraliser in which parts made from the first and second materials are static relative to one another, in use. In other words, the centralisers are effectively "one-piece".

The Applicant has termed the centraliser of the present invention the "EZEE-GLIDER"(Trade Mark).

Beneficially the centraliser may be a casing, liner or screen centraliser. However, it will be appreciated that the centraliser may be a production tubing centraliser or a drill tool or downhole tool.

In the first aspect, having a second material with a higher Youngs modulus and, therefore, increased stiffness and strength, eg at one or both ends of the centraliser, provides extra stability and strength to stop an end deforming when it strikes ledges, rings or collars during insertion or removal from a well.

In the second aspect the second material contacting the smooth surface of the tubular being centralised can be advantageously made of a low friction material while the outermost surface can be made more of a rugged first material able to withstand collisions with an abrasive rugous borehole wall.

Advantageously the first material is selected from a material comprising a polymer or plastics material, rubber, an elastomeric material, a ceramic material, cermet or submicron grained cemented carbide, aluminium, or an aluminium alloy.

Each material has a number of advantages over the other.

The first material may have a Youngs modulus of 550,000 to 1,000,000 psi, and the second material may have a Youngs modulus of 10,000,000 psi or higher. Preferably the first material provides one or more of the following material characteristics as tested by ASTM (American Society for Testing and Materials):

| | |
|---|---|
| Youngs Modulus | 550,000 psi or 600,000 psi or higher (ASTM Test - Ref D638) |
| Tensile strength | 10,000 psi or higher (ASTM Test - Ref D638) |
| Friction Factor (co-efficient of Friction) | 0.35 or lower ASTM Test - Dry (thrust washer) against steel |
| Izod input test (notched) | 1.6 and preferably 3.2 ft-lb/in or higher (ASTM Test Ref D256) |
| HDT (Heat Deflection or Distortion Temperature) | greater than 185° C. (ASTM Test Ref D648 at 66 psi) |
| Chemical resistance | Able to withstand chemical attack from most common reagents found in a drilling environment, eg hydrocarbons, brines, weak alkalis and weak acids |
| Specific gravity | 1.28 |

In one implementation the first material may be a polyphthalamide (PPA), eg a glass-reinforced heat stablilised PPA such as AMODEL, eg AMOEL-AT-1116 HS resin available from BP Amoco (see http:/www.bpamocoengpolymers.com).

In another implementation the first material may be a polymer of carbon monoxide and alpha-olefins, such as ethylene.

Advantageously, the first material may be an aliphatic polyketone made from co-polymerisation of ethylene and carbon monoxide-optionally with propylene.

Advantageously, the first material may be CARILON (Trade Mark) available from Shell Chemicals. CARILON (Trade Mark) is a class of semi-crystalline thermoplastic materials with an alternating olefin-carbon monoxide structure.

In a further implementation the first material may be a nylon resin.

Advantageously the first material may be an ionomer modified nylon 66 resin.

The first material may be a nylon 12 resin, e.g. RILSAN (Trade Mark) available from Elf Atochem.

In a yet further alternative implementation the first material may be a modified polyamide (PA).

The first material may be a nylon compound such as DEVLON (Trade Mark) available from Devlon Engineering Ltd.

The first material may be of the polyetheretherketone family, EG PEEK (Trade Mark) available from Victrex PLC.

The first material may be ZYTEL (Trade Mark) available from Du Pont. ZYTEL (Trade Mark) is a class of nylon resins which, includes unmodified nylon homopolymers (e.g. PA 66 and PA 612) and copolymers (e.g. PA 66/6 and PA 6T/MP-MDT etc) plus modified grades produced by the addition of heat stabilizers, lubricants, ultraviolet screens, nucleating agents, tougheners, reinforcements etc. The majority of resins have molecular weights suited for injection moulding, roto-moulding and some are used in extrusion.

Alternatively the first material may be VESCONITE (Trade Mark) available from Vesco Plastics Australia Pty Ltd.

Alternatively the first material may be polytetrafluoroethylene (PTFE).

In such case the first material may be TEFLON (Trade Mark) or a similar type material. TEFLON (Trade Mark) filled grades of PEEL CARILON (Trade Mark) may be used. These materials are suitable for roto-moulding which is a favoured method of manufacture for economic reasons for larger component sizes, eg greater than 9-⅝". Alternatively, the first material may be PA66, FG30, PTFE 15 from ALBIS Chemicals.

The ceramic material may be, for example, zirconia, titania and/or aluminia. The ceramic material may be toughened by addition of a further material, for example, zirconia with the addition of alumina.

Alternatively, the first material may be a metal. Preferably, the metal is a soft metal such as aluminium.

The outermost surface of said body may provide or comprise a plurality of raised portions.

The raised portions may be in the form of longitudinally extending blades or ribs or may alternatively be in the form of an array of nipples or lobes.

Adjacent raised portions may define a flow path therebetween such that fluid flow paths are defined between first and second ends of the tubular body.

Where the raised portions comprise longitudinal blades, such blades may be formed, at least in part, substantially parallel to an axis of the tubular body.

Alternatively, the blades may be formed in a longitudinal spiral/helical path on the tubular body.

Advantageously adjacent blades may at least partly longitudinally overlap upon the tubular body.

Preferably adjacent blades may be located such that one end of a blade at one end of the tubular body is at substantially the same longitudinal position as an end of an adjacent blade at another end of the tubular body.

More preferably, the blades may have an upper spiral portion, a middle substantially straight portion and a lower tapered portion.

Advantageously the second material may be a metallic material.

Preferably, the second material may be a bronze alloy such as phosphur bronze or lead bronze, or alternatively, zinc or a zinc alloy.

In a preferred embodiment the second material is lead bronze. Bronze is advantageously selected as it has a high Youngs Modulus (16,675,000 psi) compared to CARILON (around 900,000 psi) ZYTEL (around 600,000 psi) and AMODEL (870,000 psi) while having friction properties which are better than steel.

Preferably, in the first aspect at least a portion of an innermost surface of the tubular body may be formed from the second material.

Advantageously, the innermost surface is formed from the second material.

This arrangement provides an inner core with good strength, low friction properties and shock loading.

Preferably, in the second aspect a portion of or adjacent to first and/or second ends of the tubular body may be formed from the second material.

The second material may be arranged in an annulus of a body of the first material.

More preferably there are two annular bodies of the second material each located at respective ends of the body of the first material.

Additionally, the centraliser may include a reinforcing means such as a cage, mesh, bars, rings and/or the like. The reinforcing means may be made from the second material.

At least part of the centraliser according to the first or second aspects of the present invention may be formed from a casting process.

Alternatively or additionally, at least part of the centraliser according to the first or second aspects of the present invention may be formed from an injection moulding process.

Advantageously, at least part of the centraliser according to the first or second aspects of the present invention may be formed from an injection moulding or roto-moulding process.

Advantageously, also a body of the second material may be retained relative to a body of the first material by an interference fit.

It will be appreciated that the polymeric materials mentioned above may include filler materials, as is known in the polymer art.

The first material may be around a factor of four times lighter than the second material in air, but may be around a factor of ten times lighter than the second material in water.

According to a third aspect of the present invention there is provided a centralising apparatus for use in a well-bore, the centralising apparatus including a tubular section and at least one centraliser located thereupon, wherein the centraliser comprises a tubular body, a portion of an outermost surface of said tubular body being formed from a first material and a portion of or adjacent to at least one end of said tubular body being formed from a second material, the first material having a lower Youngs modulus than the second material.

According to a fourth aspect of the present invention there is provided a centralising apparatus for use in a well-bore, the centralising apparatus including a tubular section and at least one centraliser located thereupon, wherein the centraliser comprises a tubular body, a portion of an outermost surface of said tubular body being formed from a first material and a portion of an innermost surface of said tubular body being formed from a second material, the first material having a lower Youngs modulus than the second material.

In a first preferred embodiment the tubular section may be a well-bore casing or liner.

In a second embodiment the tubular section may be a length of production tubing.

In a third embodiment the tubular section may be a screen.

The at least one centraliser may be located so as to surround the tubular section, i.e. the tubular section may be located within the at least one centraliser.

The at least one centraliser may be located relative to the tubular section by means of a collar.

The at least one centraliser may be located relative to the tubular section, and may be rotatable relative to the tubular section around a longitudinal axis thereof.

According to a fifth aspect of the present invention there is provided a method of fixing a casing or liner into a well-bore, the method comprising the steps of:

providing a well casing/liner;

providing at least one centraliser, the/each centraliser comprising a tubular body, a portion of an outermost surface of said tubular body being formed from a first material and a portion of or adjacent to at least one end of said body and/or an innermost surface of said tubular body being formed from a second material, the first material having a lower Youngs modulus than the second material;

locating the at least one centraliser on the casing/liner at a desired position so as to provide a centralising apparatus;

placing the centralising apparatus within the well-bore; and pumping cement slurry or the like into an annular space between an exterior of the casing/liner and the well-bore.

According to a sixth aspect of the present invention there is provided a method of completing a well, the method comprising the steps of:

providing a length of production tubing;

providing at least one centraliser, the/each centraliser comprising a tubular body, a portion of an outermost surface of said tubular body being formed from a first material and a portion of or adjacent to at least one end and/or an innermost surface of said tubular body being formed from a second material, the first material having a lower Youngs modulus than the second material;

locating the at least one centraliser on the production tubing at a desired position so as to provide a centralising apparatus;

placing the centralising apparatus within a cased or lined well-bore.

Preferably the method comprises the further step of:

securing a bottom of a length of the production tubing with a packer to seal the tubing to a casing/liner.

According to a seventh aspect of the present invention there is provided a method of gravel packing a well, the method including the steps of:

providing a screen;

providing at least one centraliser, the/each centraliser comprising a tubular body, a portion of an outermost surface of said tubular body being formed from a first material and a portion of or adjacent to at least one end and/or an innermost surface of said tubular body being formed from a second material, the first material having a lower Youngs modulus than the second material;

locating the at least one centraliser on the screen to provide a centralising apparatus;

placing the centralising apparatus within a borehole or perforated casing.

Preferably the method comprises the further step of:

placing sand into an annular space between an exterior of the screen and the well-bore or perforated casing.

BRIEF DESCRIPTION OF THE DRAWINGS

Figure 1:
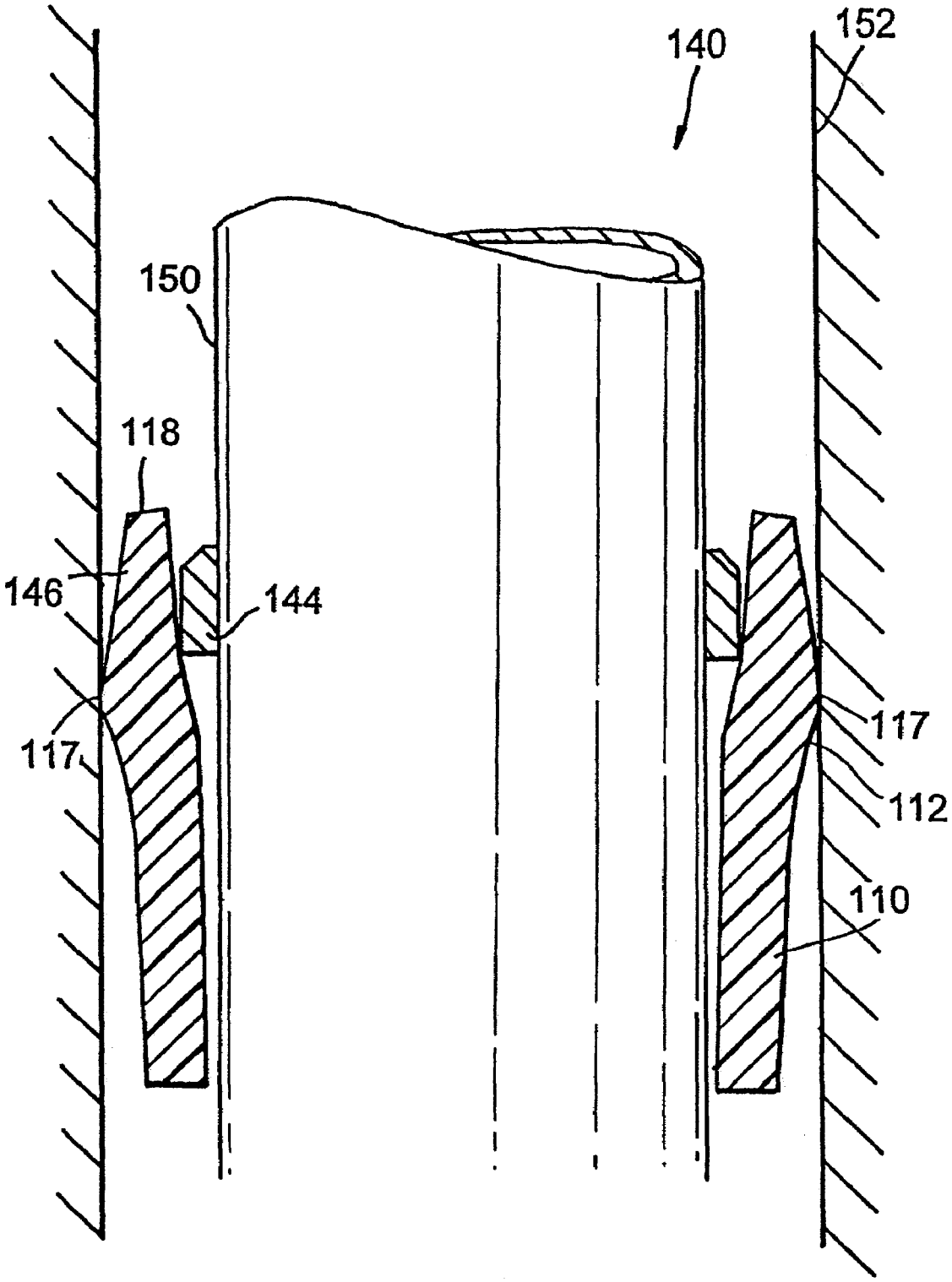
Figure 2:
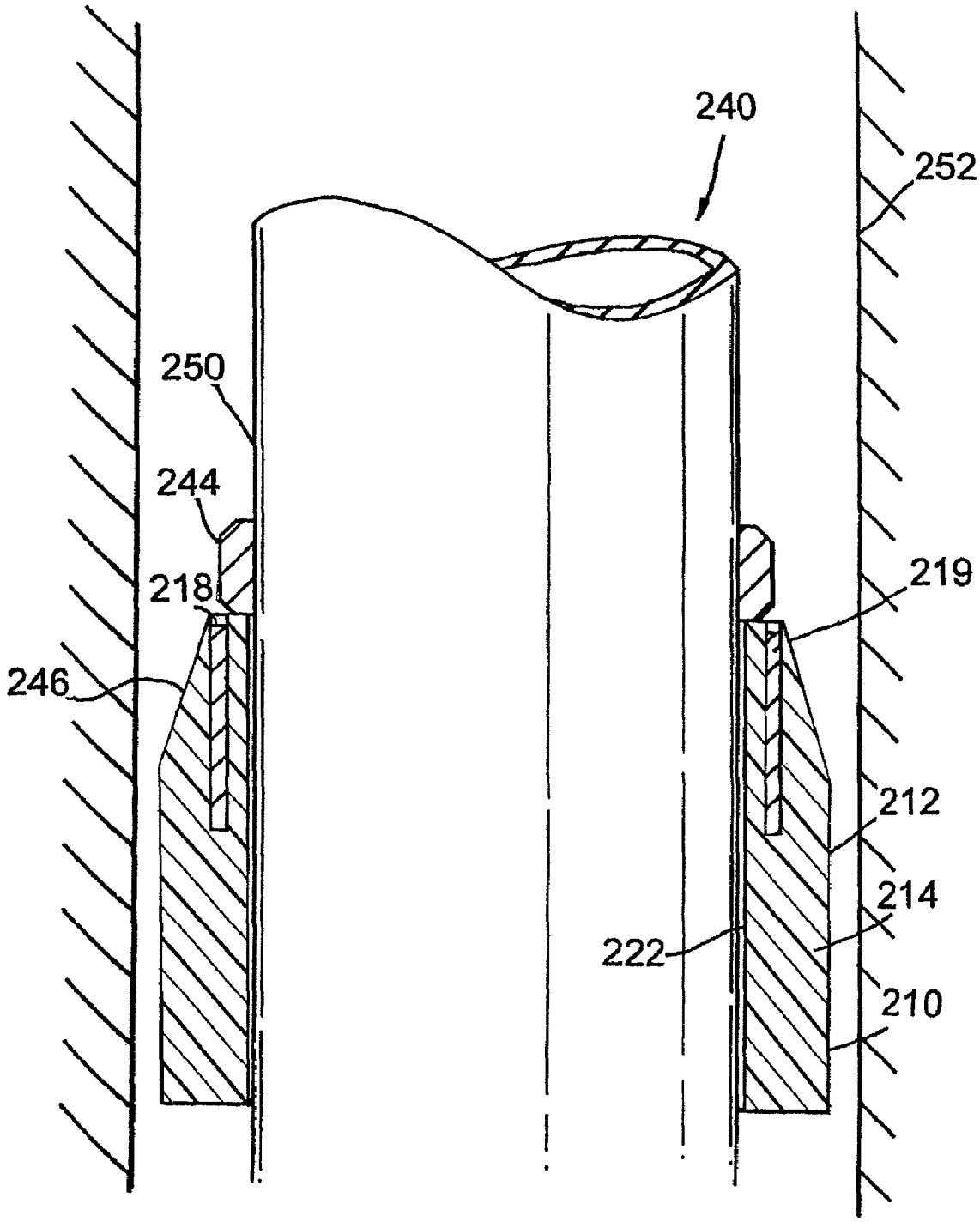
Figure 3:
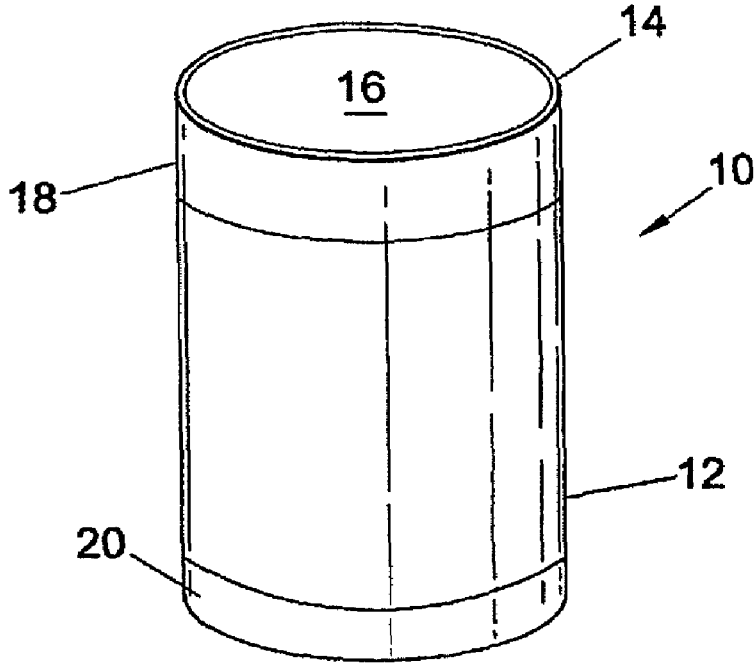
Figure 4:
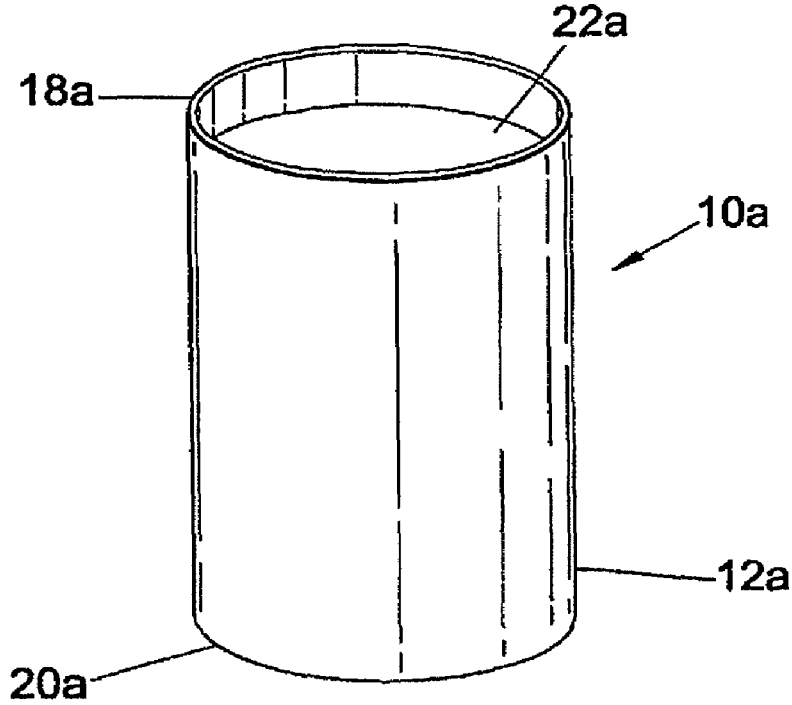
Figure 5:
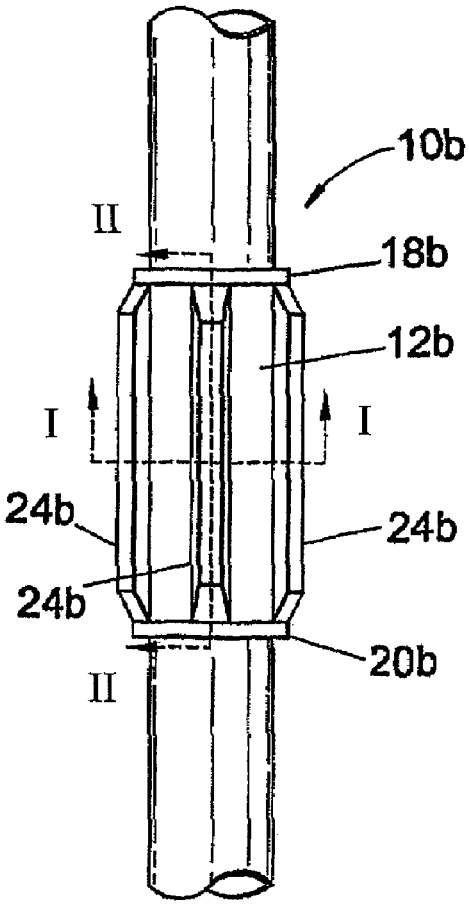
Figure 6A:
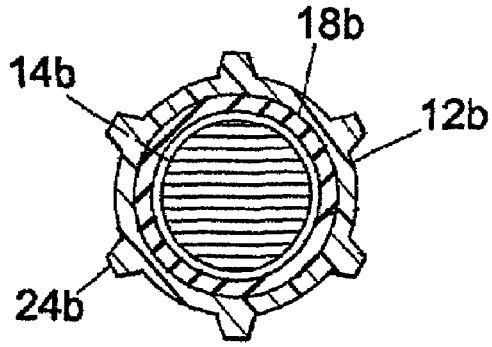
Figure 6B:
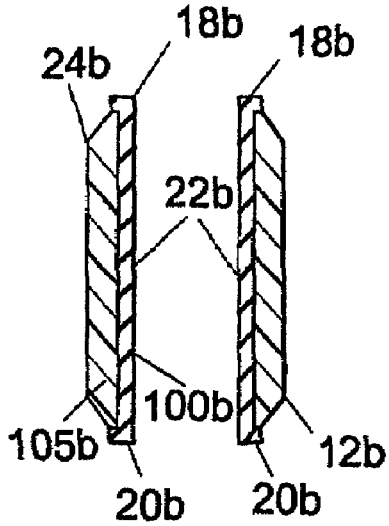
Figure 7A:
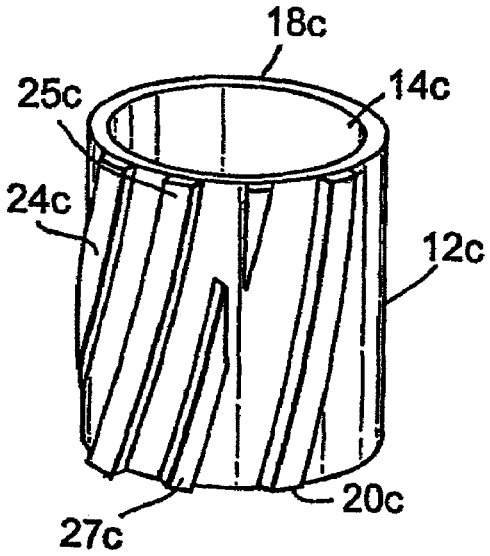
Fig. 7a (Prior Art)
Figure 7B:
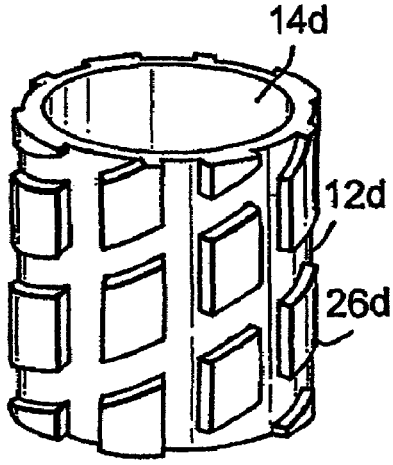
Fig. 7b (Prior Art)
Figure 7C:
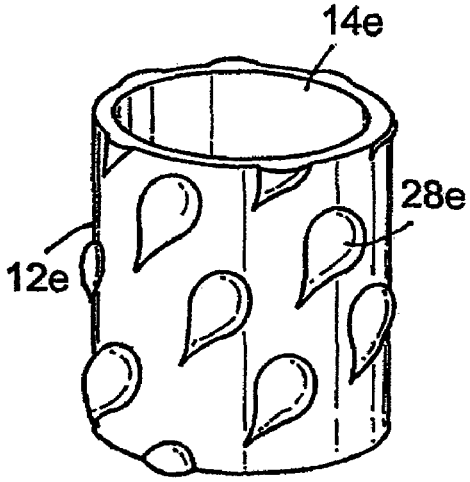
Fig. 7c (Prior Art)
Figure 7D:
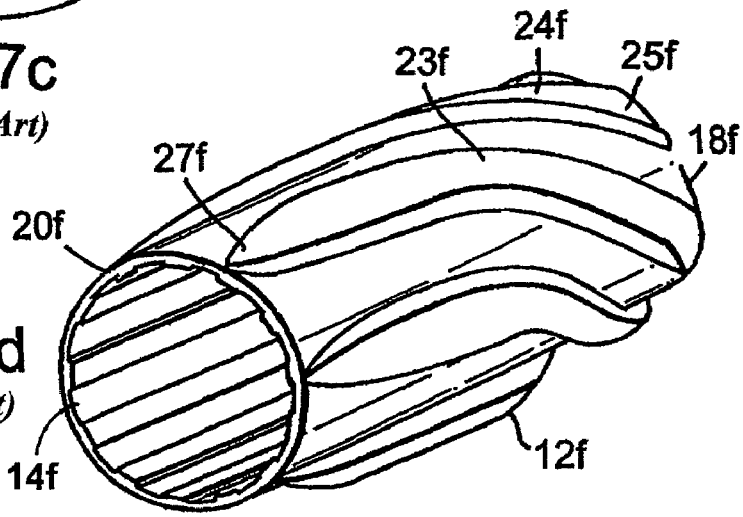
Fig. 7d (Prior Art)
Figure 7E:
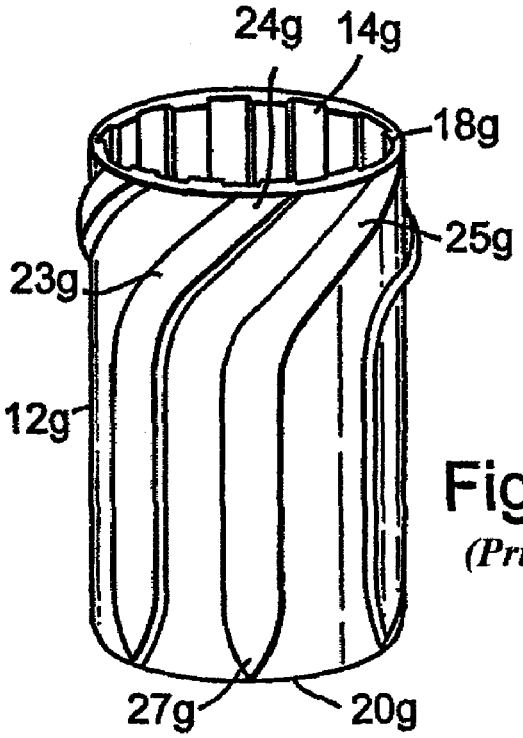
Fig. 7e (Prior Art)
Figure 7F:
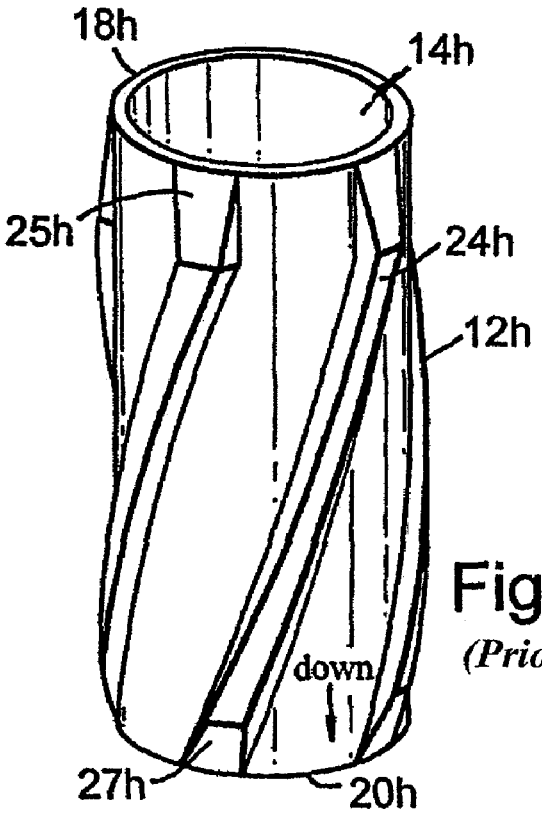
Fig. 7f (Prior Art)
Figure 7G:
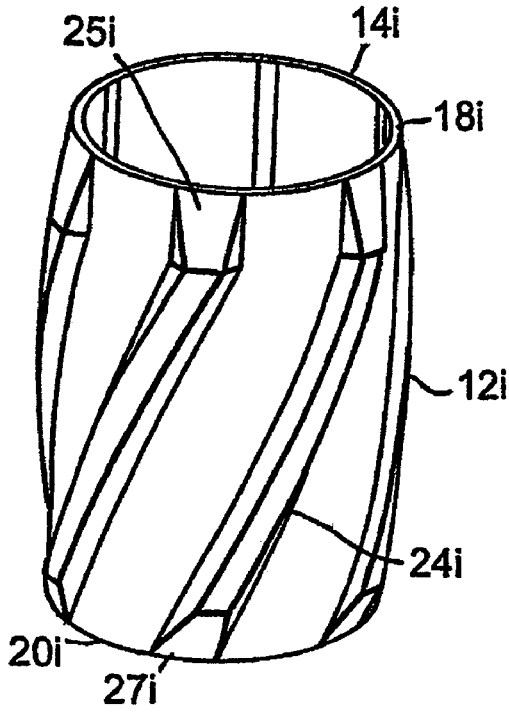
Fig. 7g (Prior Art)
Figure 7H:
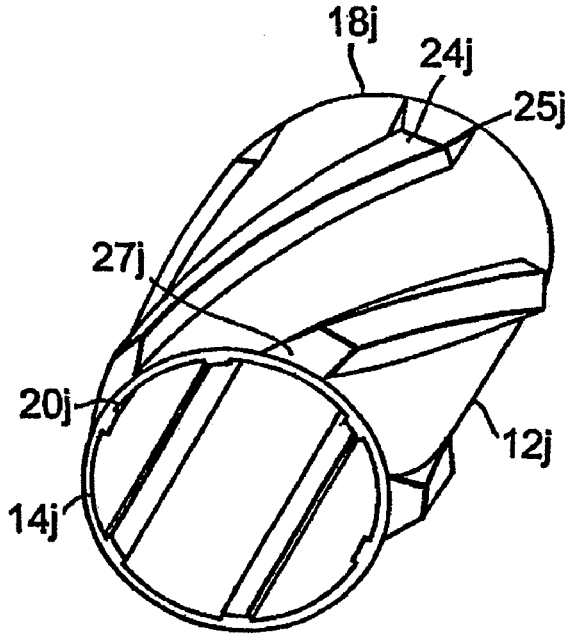
Fig. 7h (Prior Art)
Figure 8A:
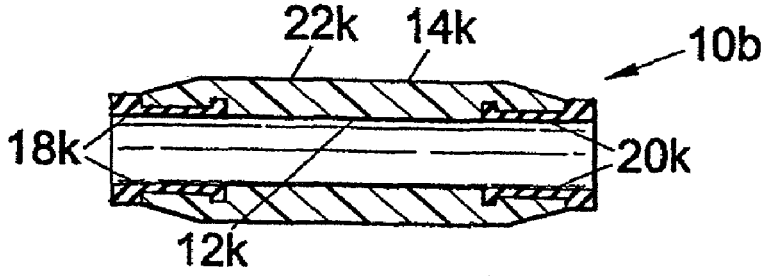
Figure 8B:
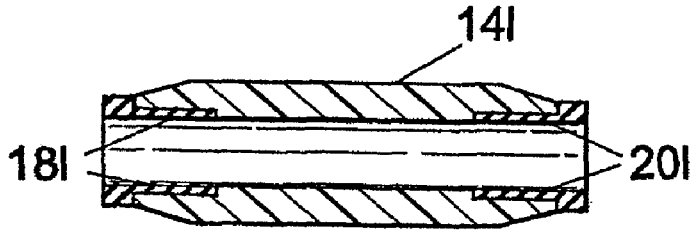
Figure 8C:
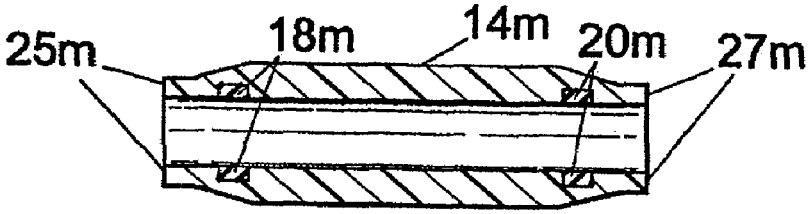
Figure 8D:
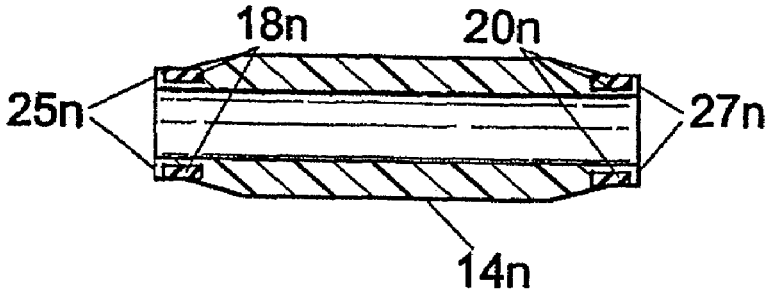
Figure 9:
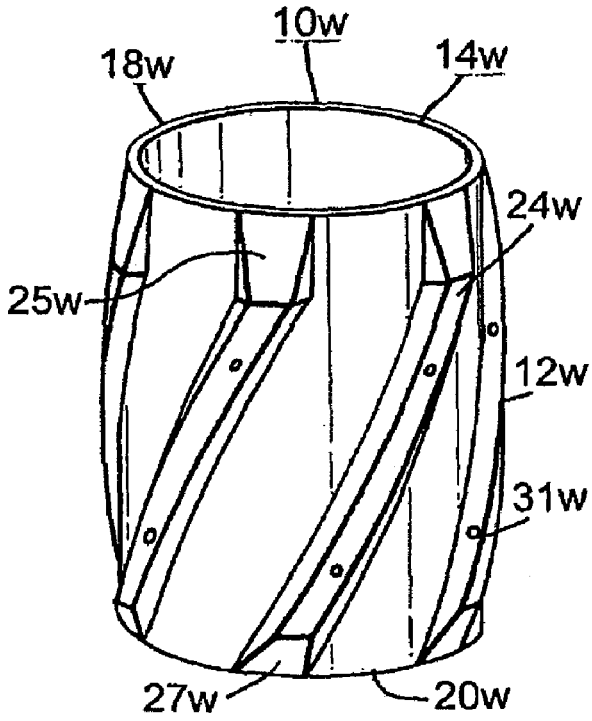
Figure 10:
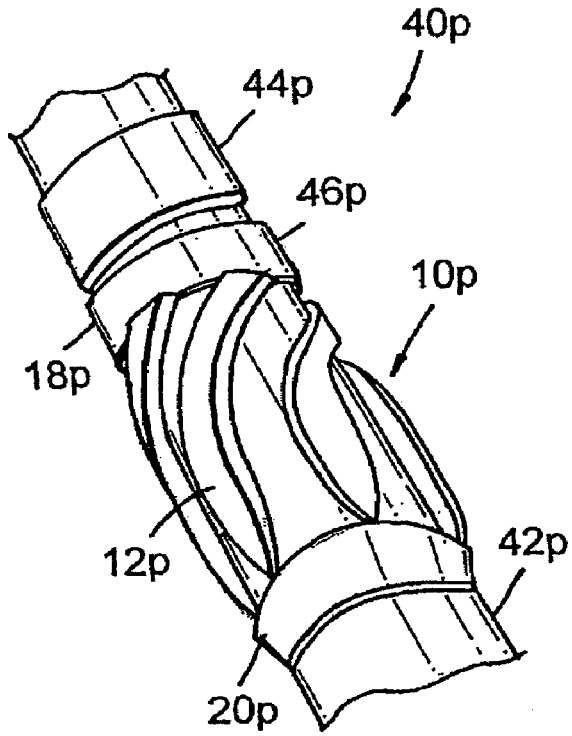
Figure 11:
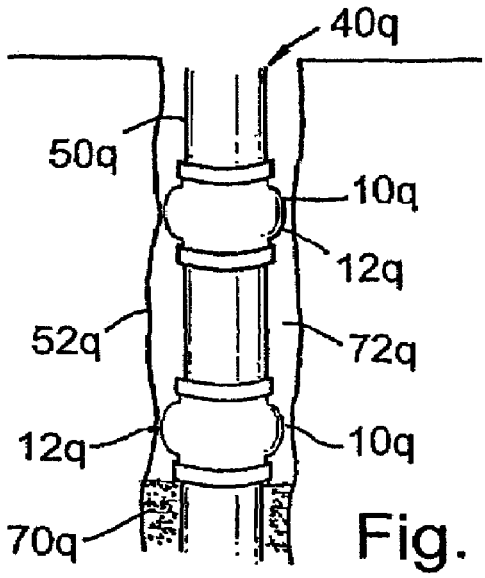
Figure 12:
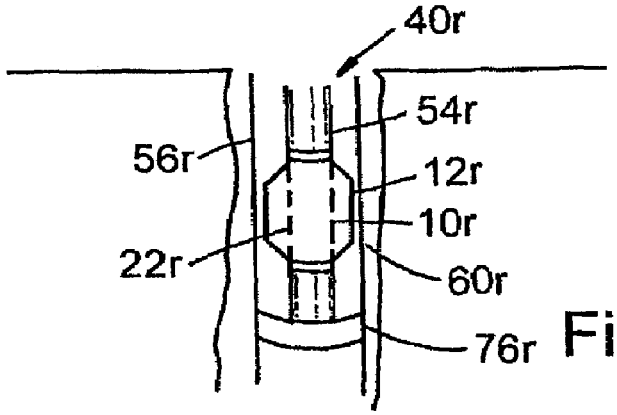
Figure 13A:
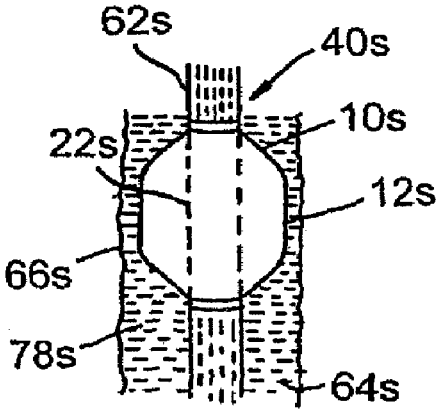
Figure 13B:
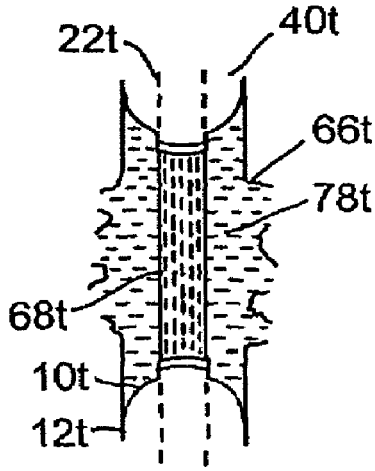
Figure 14A:
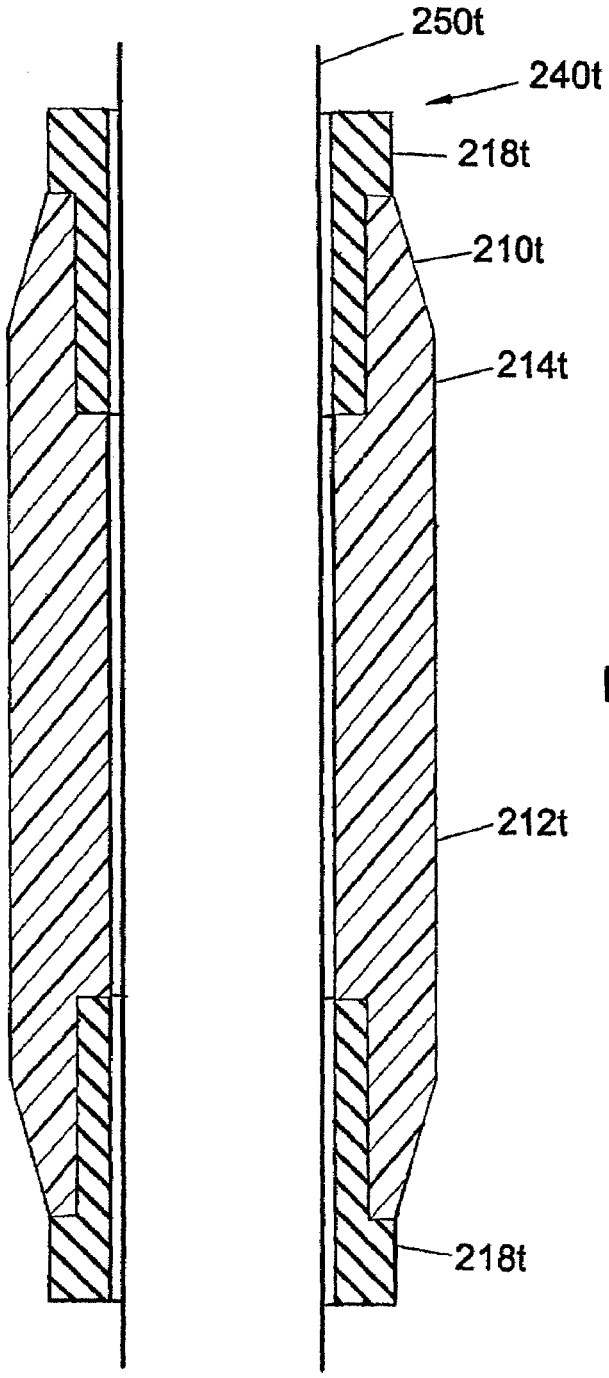
Figure 14B:
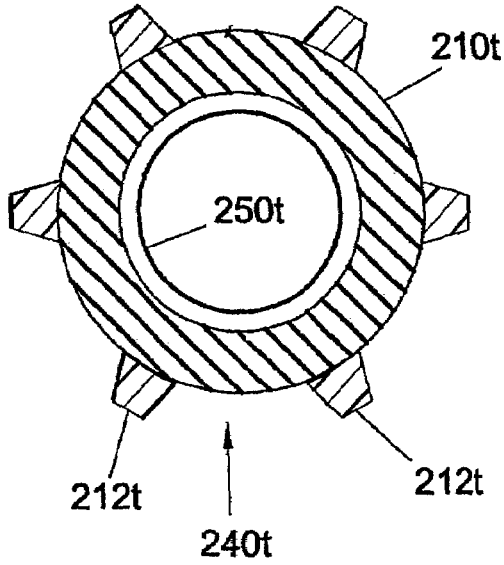
Figure 15A:
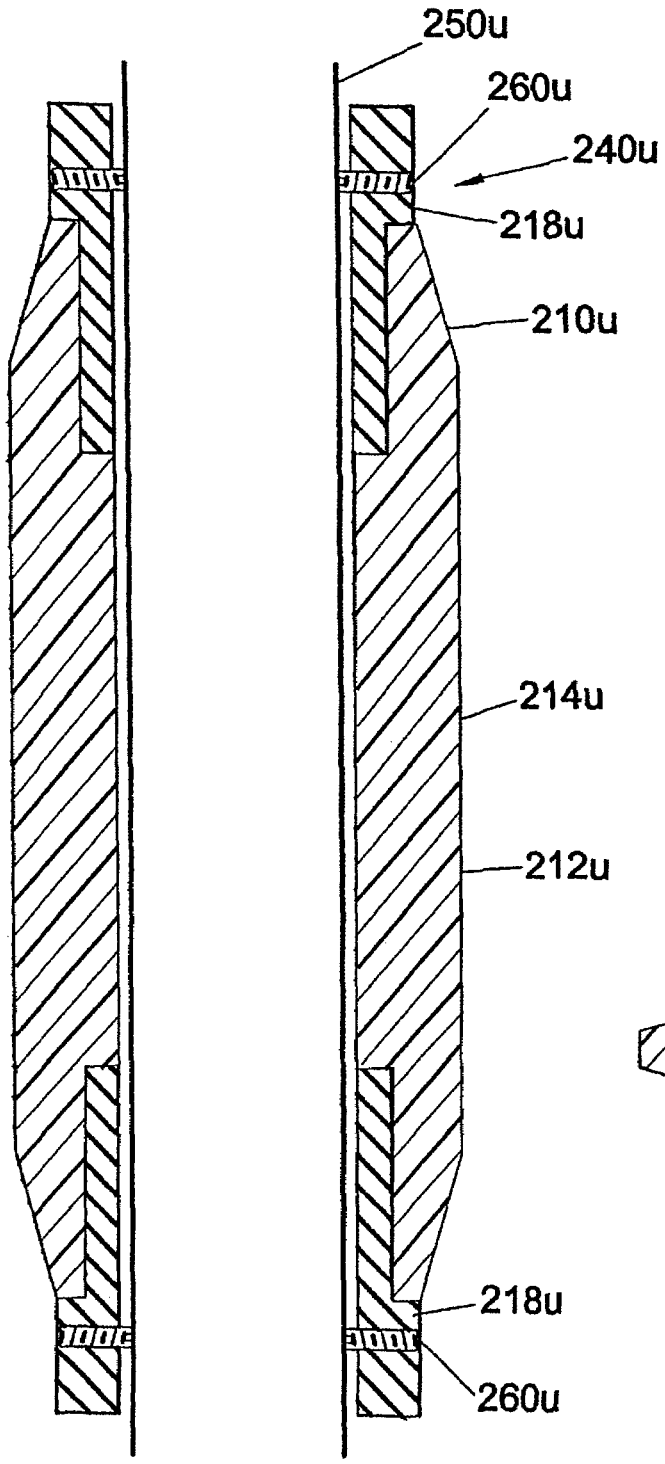
Figure 15B:
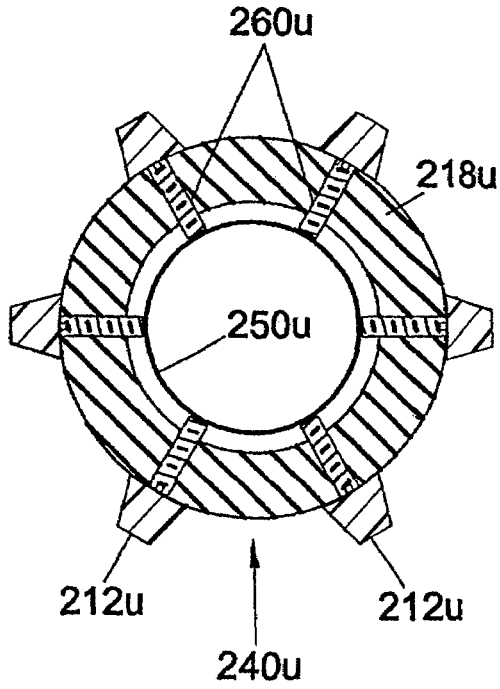

Having thus described the invention in general terms, reference will now be made to the accompanying drawings, which are not necessarily drawn to scale, and wherein:

A number of embodiments of the present invention will now be described, by way of example only, with reference to the accompanying drawings which are:

FIG. 1 a cross-sectional view of a prior art centralising apparatus within a well-bore;

FIG. 2 a cross-sectional view of a centralising apparatus according to a first embodiment of the present invention;

FIG. 3 a perspective view from one side and above of a centraliser according to a second embodiment of the present invention;

FIG. 4 a perspective view from one side and above of a centraliser according to a third embodiment of the present invention;

FIG. 5 a side view of a centraliser according to a fourth embodiment of the present invention;

FIGS. 6(*a*) and (*b*) cross-sectional views of the centraliser of FIG. 5 along section lines I-I and II-II, respectively;

FIGS. 7(*a*)-(*h*) examples of outermost surfaces of centralisers according to modifications of embodiments of the present invention;

FIGS. 8(*a*)-(*d*) cross-sectional views of various modifications to the centraliser of FIG. 5 taken through section line II-II;

FIG. 9 a perspective view from one side and above of a centraliser according to a fifth embodiment of the present invention;

FIG. 10 A perspective view from one side and above of a centralising apparatus according to a sixth embodiment of the present invention;

FIG. 11 a perspective view of a centralising apparatus positioned within a well-bore for cementing a well according to a seventh embodiment of the present invention;

FIG. 12 a perspective view of a centralising apparatus positioned within a casing/liner for completing a well according to an eighth embodiment of the present invention;

FIGS. 13(*a*) and (*b*) perspective views of a centralising apparatus positioned within a borehole and within a perforated casing respectively, for gravel packing a well according to ninth and tenth embodiments of the present invention;

FIGS. 14(*a*) and (*b*) side and end cross-sectional views of a centralising apparatus according to an eleventh embodiment of the present invention;

FIGS. 15(*a*) and (*b*) side and end cross-sectional views of a centralising apparatus according to a twelfth embodiment of the present invention; and FIGS. 16(*a*) and (*b*) side and end cross-sectional views of a centralising apparatus according to a thirteenth embodiment of the present invention.

DETAILED DESCRIPTION OF DRAWINGS

Reference is initially made to FIG. 1 of the drawings which depicts a centralising apparatus, generally indicated by reference numeral 140 as an example of the prior art. Centralising apparatus 140 is located within borehole 152. Centralising apparatus 140 comprises tubular 150 and centraliser 110. The tubular 150 includes a stop collar 144. Centraliser 110 is made of a unitary construction, ie of a single piece of polymeric material such as a plastic, elastomeric or rubber material. Demonstrated in FIG. 1 is an example of what may occur when the centraliser 110 strikes a ledge or other obstruction when being run. Outermost surface 112 of centraliser 110 sticks at a contact point. The tubular 150 is driven against the centraliser end 118 which will ride over the stop collar 144. Rounded edges on the end 118 can exacerbate the problem. Nose 146 of the centraliser 110 deforms as the plastic material is forced over the stop collar 144. As a result both centraliser 110 and tubular 150 become stuck in the bore hole. Time and costs arise in withdrawing the tubular 150 and replacing the centraliser 110.

FIG. 2 shows a first embodiment of the present invention which addresses one or more of the disadvantages of the prior art. Centralising apparatus 240 comprises a tubular 250 with stop collar 244 and centraliser 210. Centralising apparatus 240 is located within borehole 252. The centraliser 210 comprises a tubular body 214, a portion of an outermost surface 212 is formed from a first material and a portion of at least one end 218 is formed from a second material, ie insert band 219. The first material has a lower Youngs modulus than the second material. The centraliser 210 is a "composite centraliser", termed "EZEE-GLIDER" (Trade Mark) by the Applicant. A detailed description of the centraliser 210 is provided hereinafter.

As the second material has a higher Youngs modulus than the first material, the centraliser 210 has an increased stiffness and strength at end 218. Thus centraliser 210 has a body 214 which provides an innermost surface 222 and an outermost surface 212. Advantageously the increased strength at the end 218 helps to prevent the nose 246 deforming if it strikes or is struck by a stop collar 244.

Referring now to FIG. 3, there is shown a second embodiment of a centraliser for a tubular (e.g. a casing, liner, screen or even production tubing, or the like), generally designated 10, according to the present invention. At least a portion of an outermost surface 12 of the centraliser 10 is selected from a first material advantageously providing a good tribiological performance and comprising a polymeric/plastics material, rubber, an elastomeric material, a ceramic material, cermet or submicron grained carbide. In one form of this embodiment the first material is a thermoplastic polymer, particularly a polymer of carbon monoxide and alpha-olefins, and more particularly CARILON (Trade Mark) available from Shell Chemicals, as will hereinafter be discussed in greater detail. In an alternative, and preferred form of this embodiment, the first material is a polyphthalamide (PPA), such as AMODEL available from BP Amoco. AMODEL is a semi-crystalline polymer offering good mechanical properties over a broad temperature range. AMODEL exhibits a high Heat Deflection Temperature (HTD), high flexural modulus and high tensile strength, as well as good creep resistance and low moisture absorption. In a further form of this embodiment the material is polytetrafluoroeth(yl)ene (PTFE), and particularly TEFLON (Trade Mark). In a yet further alternative form of this embodiment the material is a ceramic material, for example, selected from zirconia, titania, and/or alumina perhaps toughened with titanium carbide, or alternatively a titanium based ceramic, perhaps with additions or aluminium/boron and nitrogen, or alternatively silicon nitride.

The centraliser 10 comprises a tubular body 14. The tubular body 14 has a bore 16 extending longitudinally therethrough. The body 14 is provided with outermost surface 12 and ends 18 to 20. Each end 18, 20 is formed from a selected second material, e.g. a metallic material. In an embodiment of the present invention, the ends 18, 20 are made of phosphor bronze. In an alternative embodiment the ends 18, 20 are made of lead bronze. This selection of materials ensures that the ends 18, 20 or "nose" of the centraliser 10 has a higher Youngs modulus than that of the body 16, and has friction properties better than steel. The Youngs modulus of CARILON/ZYTEL/AMODEL (Trade Marks) is around 900,000 psi compared to 16,675,000 psi for bronze. Thus in bronze, a stress of circa 20 times that required to deform a plastic end 18, 20 is required. To deform either end 18, 20 over a stop collar (3% strain) requires ±4 tonnes for CARILON/ZYTEL/AMODEL (Trade Marks), but 88 tonnes bronze. In use, the likely loading is likely in the 10 to 20 tonnes range.

Reference is now made to FIG. 4 of the drawings which depicts a centraliser 10*a*, having ends 18*a*, 20*a* and an innermost surface 22*a* and outermost surface 12*a*. In this embodiment the outermost surface 12*a* comprising a first material, e.g. a polymeric/plastics material, rubber, an elastomeric material, a ceramic material, cermet or submicron grained carbide. In one form of this embodiment the first material is a thermoplastic polymer, particularly a polymer of carbon monoxide and alpha-olefins and more particularly CARILON (Trade Mark) available from Shell Chemicals, as will hereinafter be discussed in greater detail. In an alternative, and preferred form of this embodiment, the first material is polyphthalmide (PPA) such as AMODEL available from BP Amoco. In a yet further form of this embodiment the material is polytetrafluoroeth(yl)ene (PTFE), and particularly TEFLON. In a yet further alternative form of this embodiment the first material is a ceramic material, for example selected from zirconia, titania, and/or alumina perhaps toughened with titanium carbide, or alternatively a titanium based ceramic, perhaps with additions or aluminium/boron and nitrogen, or alternatively silicon nitride. This provides a tough abrasive resistant outer body. Ends 18*a*, 20*a* and the innermost surface 12*a* are constructed from lead bronze. This composite centraliser 10*a* has the advantages of a rigid inner body providing an improved journal bearing and also ends for good thrust load bearing.

CARILON (Trade Mark) is a semi-crystalline aliphatic polyketone as disclosed in Shell Chemical Literature available from their web-site http://www.shellchemical.com as at Nov. 10, 1998 and included herein by reference.

According to the literature CARILON (Trade Mark) is characterised by the following:

- Short moulding cycles and good mould definition
- Low warpage and no need for post-moulding conditioning
- Superior resilience and snapability
- Very good impact performance over a broad temperature range
- Very good chemical resistance and barrier performance
- Very good hydrolytic stability
- Good friction/wear characteristics and low noise generation A range of CARILON (Trade Mark) is used depending on the performance required and the fabrication method, i.e. extrusion or injection moulding. The current range is:

- SC:2544-97-CARILON® D26CX100-Advanced extrusion grade
- SC;2545-97-CARILON® D26FX100-General purpose extrusion grade
- SC:2546-97-CARILON® D26HM100-General purpose injection moulding grade
- SC:2547-97-CARILON® D26VM100-High-flow injection moulding grade
- SC:2548-97-CARILON® DB6G3A10-15% Glass reinforced general-purpose injection moulding grade
- SC:2549-97-CARILON® DB6GA10-30% Glass reinforced general-purpose injection moulding grade
- SC;2550-97-CARILON® DB6FOA10-Flame retarded (V-0), injection moulding grade
- SC:2551-97-CARILON® DB6F5G40-Flame retarded (V-0), 20% glass reinforced, injection moulding grade
- SC:2552-97-CARILON® DB6F1G40-Flame retarded (V-1) tracking resistance 15% glass reinforced injection moulding grade
- SC:2533-97-CARILON® DA6L1A10-Lubricated injection moulding grade
- SC:2554-97-CARILON® DA6P2L10-High performance lubricated injection moulding grade
- SC:2557-97-CARILON® DB6G6P30-Lubricated glass reinforced injection moulding grade For some environments ZYTEL (Trade Mark) can be used.

ZYTEL (Trade Mark) is a nylon resin available from Du Pont which can be injection moulded, and is disclosed on their web-site http://www.dupont.com as at Nov. 12, 1998, included herein by reference. Currently thirteen grades of ZYTEL (Trade Mark) can be used, namely:

- 408L NCO Ionomer modified nylon 66 resin
- 450HSL BK 152 Olefinic/rubber modified nylon 66 resin
- 3189 NCO10 Cube blend, stiff, rubber modified nylon 66 resin
- FN718 010 Flexible grafted ionomer modified nylon 66 resin
- FN714 NC010 Very flexible grafted ionomer modified nylon 66 resin
- CFE4003HS BK245 Heat stabilized toughened black nylon 66 resin
- CFE4004HS NC010 Heat stabilised toughened nylon 66 resin
- CFE4005HS BK246 Heat stabilized highly toughened black nylon 66 resin CFE4006HS NCO10 Heat stabilized highly toughened nylon 66 resin which are toughened nylons and ST801 NC010 Grafted rubber modified nylon 66 resin ST801W NC010 Grafted rubber modified nylon 66 resin ST901L NC095 Grafted rubber modified nylon 66 resin ST901L NC010 Grafted rubber modified amorphous nylon resin which are super tough nylons.

A further alternative plastic material which can be used in VESCONITE (Trade Mark). It is available from Vesco Plastics Australia Pty Ltd. VESCONITE (Trade Mark) exhibits greater hardiness, lower friction, negligible water absorption and higher chemical resistance than nylon. VESCONITE (Trade Mark) can be machined. Of better quality is VESCONITE HILUBE (Trade Mark) which can be injection moulded.

Referring now to FIG. 5 there is illustrated a centraliser 10*b* according to a fourth embodiment of the present invention. The centraliser 10*b* is of composite construction with ends 18*b*, 20*b* and innermost surface 22*b*, as shown in FIGS. 4*a* and 4*b*, comprising of a lead bronze body 100*b* bonded to a tough abrasion resistant material body 105*b*, in this embodiment CARILON (Trade Mark) or AMODEL (Trade Mark), providing outermost surface 12*b*. The outermost surface 12*b* of the body includes a number of raised portions in the form of longitudinally extended blades 24 or ribs. Adjacent blades define a flow path between the ends 18*b*, 20*b* of the body 14*b*. The blades 24 are parallel to an axis of the tubular body 14*b*.

FIGS. 7(*a*)-(*h*) show a variety of outermost surfaces 12*c-j* which can be made in a plastics material, by way of example. Ends and innermost surfaces have been omitted from these figures to aid clarity. FIGS. 7(*b*) and 7(*c*) illustrate arrays of nipples 26*d* or lobes 28*e* as the raised portions.

FIGS. 7(*a*), 7(*d*)-(*h*) show an outermost surface of raised portions in the form of blades 24*c, f-j* wherein adjacent blades partly longitudinally overlap on the tubular body 14*c-j*. For some embodiments e.g. FIGS. 7(*a*), 7(*f*), 7(*g*) and 7(*h*) adjacent blades are located such that one end of a blade 25*c,h-j* at one end 18*c,h-j*, the tubular body 14*c,h-j* at the same longitudinal position as an end 27*c,h-j* of an adjacent blade at another end 20*c,h-j* of the tubular body 14*c,h-j*. FIGS. 7(*d*) and 7(*e*) illustrate blades 24*f,g* having an upper spiral section 25*f,g* a middle substantially straight section 23*f,g* and a lower tapered section 27*f,g*. In these embodiments the outermost surfaces 12*c-j* may be moulded, eg injection moulded, at surface 14*c-j*, onto a metallic tubular body (not shown).

Reference is now made to FIG. 8 which shows a series of modified embodiments, each shown through section II-II of FIG. 5, of modifications to the centraliser 10*b* according to the present invention. These FIGS. 8(*a*)-(*d*) illustrate, by way of example only, possible arrangements of the two materials which make up the centraliser 10*b*.

FIG. 8(*a*) shows ends 18*k*, 20*k* having portions of a second material, preferably leaded bronze, bonded or otherwise fixed (e.g. by an interference fit) to a tubular body 14*k* by a snap ring type arrangement. Innermost 22*k* and outermost 12*k* surfaces are formed from the first material, preferably CARILON (Trade Mark) or AMODEL (Trade Mark) , as described hereinbefore.

In FIG. 8(*b*), ends 181, 201 have smaller bonded sections of leaded bronze arranged as a ring around the tubular body 141.

FIGS. 8(*c*) and 8(*d*) illustrate embodiments where the second material is a ring sited at each end, but away from annular faces 25*m,n*, 27*m,n* of the ends. In these embodiments part of the innermost surface, part of the outermost surface and/or part of end surfaces are all made of the first material, eg CARILON (Trade Mark) or AMODEL (Trade Mark). The second material, leaded bronze, formed in an integral ring or annulus provides stability and rigidity to the centraliser 10*b*.

The centraliser 10*b* may be formed from an injection moulding process. Alternatively, the centraliser 10*b* may be formed from a casting process. Advantageously, the centraliser 10*b* is formed from a roto-moulding process. Those of skill in the art will appreciate the appropriate process for each embodiment shown. For some embodiments eg FIGS. 5 to 6(*b*), the second material may be cast while the first material is injection moulded as a plastic coating over a metallic body. Thus the second material may be "bonded" to the first.

Reference is now made to FIG. 9 of the drawings which depicts a centraliser, generally indicated by reference numeral 10*w*, according to a fifth embodiment of the present invention. Centraliser 10*w* includes a tubular body 14*w* which is of a second material preferably a metallic material. A portion 24*w* of the outermost surface 12*w* of the centraliser 10*w* is of a first material preferably a plastics material, rubber or elastomeric material. The first material has a lower Youngs modulus than the second material. The portion of the outermost surface 12*w* comprises a series of longitudinally extending blades 24*w*. The blades 24*w* may be modified to have a shape, position and orientation as shown in FIGS. 7(*a*),(*d*)-(*h*) When assembled, the blades 24*w* are attached to outermost surface 12*w* of the body 14*w*, e.g. by bonding, bolting, screwing or the like, at connection points 31*w*.

Referring now to FIG. 10 there is illustrated centralising apparatus, generally indicated by reference numeral 40*p*, according to a sixth embodiment of the present invention. The apparatus 40*p* comprises a tubular section 42*p* onto which is mounted at least one centraliser 10*p* as described hereinbefore. The centraliser 10*p* includes an outermost surface 12*p* as described hereinbefore with reference to FIGS. 7(*d*) and 7(*e*). The outermost surface is made of a first material preferably CARILON (Trade Mark) or AMODEL (Trade Mark). Ends 18*p*, 20*p* are formed from a second material, preferably leaded bronze such that the first material has a lower Youngs modulus than the second material. The innermost surface (not shown) may be made of the first material or beneficially of the second material. The tubular section 42*p* may be a casing, liner, production tubing or screen. The centraliser 10*p* may be rotatable relative to the tubular section 42*p* along a longitudinal axis thereof. Additionally illustrated in FIG. 10 is a stop collar 44*p*. Stop collars 44*p* may be positioned on the tubular section 42*p* at either end of the centraliser 10*p*.

During the running of the tubular section 42*p* the outermost surface 12*p* of the centraliser 10*p* may contact ledges, possibly the ledges within the BOP stack cavities and wellhead when run in a cased hole, or to ledges and rugous boreholes when run in an open hole. The effect of the centralisers end 18*p* being subjected to such forces is to drive the centraliser 10*p* along the tubular 42*p* in the opposite axial direction to that of the tubular motion. Thus "nose" 46*p* of the centraliser 10*p* is driven into the stop ring or casing collar 44*p*. When the tubular 42*p* is rotated (a common procedure when running tubular downhole, converting drag friction into torque friction) the centraliser nose 46*p* will be forced against the stop collar 44*p* and the tubular 42*p* then rotated thus causing the centraliser nose 46*p* to act as thrust bearing.

If the nose 46*p* is made of a material that is a thermoplastic material, an aluminium material or some lower Youngs Modulus material, the centraliser 10*p* may ride over the collar 44*p*, thus being stretched, so creating the possibility of jamming the centraliser 10*p* against the borehole wall. In the present invention the nose 46*p* of the centraliser 40*p* is of a material with a higher Youngs modulus than that of the body material, yet has friction properties better than steel. For the preferred embodiment, the body material is CARILON (Trade Mark) or AMODEL (Trade Mark) where the Youngs modulus of CARILON/ZYTEL/AMODEL (Trade Marks) is around 900,000 psi and AMODEL is 870,000 psi and the "nose" or end material is leaded bronze where the Youngs modulus is 16,675,000 psi. In bronze, a stress of circa 20 times that required to deform the plastic nose is required. To deform the nose 46*p* over the top collar 44*p* (3% strain) requires ±4 tonnes CARILON, 88 tonnes bronze. In use, the likely loading is in the 10 to 20 tonnes range.

Referring to FIG. 11, there is illustrated a seventh embodiment of a centralising apparatus 40*q* similar to the centralising apparatus 40*p* of FIG. 10. In FIG. 11 where the tubular section of 42*q* of the centralising apparatus 40*q* is a casing or liner 50*q*, in use, the apparatus 40*q* is located within a well bore 52*q* such that the innermost surface 22*q* of the at least one centraliser 10*q* is a clearance fit rotatable around the casing or liner 50*q* while the outermost surface 12*q* contacts the borehole walls.

In use, the centraliser 10*q* may aid cementing of a well. The casing or liner 50*q* is cemented into the well bore 52*q*, by the following method steps of:

providing a well casing/liner 50*q;* providing the at least one centraliser 10*q;* locating the least one centraliser 10*q* on the casing/liner 50*q* at a desired position so as to provide a centralising apparatus 40*q;* placing the centralising apparatus 40*q* within the well bore 52*q*; and pumping cement slurry 70*q* into an annular space 72*q* between an exterior of the casing/liner 50*q* and the well bore 52*q*.

Referring now to FIG. 12, where the tubular section 42*r* of the centralising apparatus 40*r* is a length of a production tubing 54*r*, in use, the apparatus 40*r* is located within a casing or liner 56*r* located in a borehole 58*r* such that the innermost surface 22*r* of the centraliser 10*r* is a clearance fit rotatable around the production tubing 54*r* while the outermost surface 12*r* contacts the innermost surface 60*r* of the casing or liner 56*r*.

In use, the centraliser 10*r* may aid completion of a well. This method of completing a well comprises the steps of:

providing a length of the production tubing 54*r;* providing the at least one centraliser 10*r;* locating the at least one centraliser 10*r* on the production tubing 10*r* at a desired position so as to provide centralising apparatus 40*r;* placing the centralising apparatus 40*r* within a cased or lined well bore 58*r*; and securing a bottom 74*r* of the length of production tubing 54*r* with a packer 76*r* to seal the tubing 54*r* to the casing/liner 56*r*.

Referring now to FIG. 13(*a*), where the tubular section 42*s* of the centralising apparatus 40*s* is a screen 62*s*, the screen 62*s* being a section of production tubing including slots or holes, the apparatus 40*s* is located within the open hole end of a borehole 64*s*. The outermost surface 12*s* of the centraliser 10*s* will contact the borehole wall 66*s* while the innermost surface 22*s* of the centraliser 10*s* is a clearance fit rotatable around the screen 62*s*.

Alternatively, as shown in FIG. 13(*b*), apparatus 40*t* may be located at a section of perforated casing 66*t* within borehole 64*t* wherein the centraliser 10*t* is then located between the outer surface of the screen 68*t* and the perforated casing 66*t*.

In use the centralisers 10*s*, 10*t* may aid in the gravel packing of a screen 62*s*, 68*t* in a well. This method of gravel packing a well includes the steps of:

providing screen 62*s*, 68*t;* providing the at least one centraliser 10*s*, 10*t;* locating the at least one centraliser 10*s*, 10*t* on the screen 62*s*, 68*t* to provide centralising apparatus 40*s*, 40*t;* placing the centralising apparatus 40*s*, 40*t* within a borehole 64*s* or perforated casing 66*t*; and placing sand 78*s*, 78*t* into an annular space between an exterior of the screen 62*s*, 68*t* and the well bore 64*s* or perforated casing 68*t*.

Referring to FIGS. 14(*a*) and 14(*b*), FIGS. 15(*a*) and 15(*b*), and FIGS. 16(*a*) and 16(*b*), there are shown side and end cross-sectional views of a centralizing apparatus according to eleventh, twelfth, and thirteenth embodiments of the present invention. Like parts of the centralizing apparatus 140*t*, 140*u*, 140*v* of FIGS. 14(*a*) and 14(*b*), FIGS. 15(*a*) and 15(*b*), and FIGS. 16(*a*) and 16(*b*), are designated by the same numerals as used for the centralizing apparatus 140 of FIG. 1, but suffixed "t", "u", and "v", respectively.

It will be appreciated that a principle advantage of the present invention is to provide a centraliser for centralising a drilltool or downhole tubular which has the combined advantages of a rigid construction to prevent deformation of the centraliser when thrust against collars or stops, while providing a centraliser with a low friction outer surface for ease of installation within, eg a bore-hole or casing.

It will be appreciated by those skilled in the art that the embodiments of the invention hereinbefore described are given by way of example only, and are not meant to limit the scope of the invention in any way. It is noted that the term "centraliser" has been used herein; however it will be appreciated that the device also acts as a "glider". In addition though the disclosed embodiments illustrate symmetrical centralisers, it will be appreciated that the second material may be provided only at a single end of the centraliser.

Further, it will be appreciated that a benefit of the embodiments hereinbefore disclosed is the provision of electrical isolation between the tubular body centralised by the centraliser, and any object or surface which the outerside of the centraliser touches or otherwise rests against. In such case the invention does not need provision of blades etc, and the invention comprises a downhole tool in the form of an electrical isolator/sheath/sleeve, eg 25 to 30 ft in length.

The invention claimed is:

1. A downhole centralizer forming one of a casing centralizer, a liner, a screen centralizer, and a production tubing centralizer, the downhole centralizer comprising:

a rigid tubular body adapted to be received on a downhole tubular element, in a clearance fit around the downhole tubular element, the tubular body including at least one first portion and at least one second portion, the at least one first portion and the at least one second portion being statically retained relative to one another, the at least one first portion comprising a tubular member having opposed ends and providing at least a portion of an outermost surface of the tubular body, the at least one first portion being substantially formed from a first material, and the at least one second portion comprising a ring member disposed about one of the ends of the tubular member, the at least one second portion being substantially formed from a second material, the first material having a lower Young's modulus than the second material, the first material substantially comprising a thermoplastic polymer, and the second material comprising a metallic material, whereby the at least one metallic second portion is configured to cooperate with the downhole tubular element such that the entire downhole centralizer is rotationally and longitudinally movable relative to the downhole tubular element, and whereby the at least one metallic second portion is configured to radially reinforce the one of the ends of the tubular member.

2. A downhole centralizer as claimed in claim 1, wherein at least one of the at least one first portion and the at least one second portion is circumferentially formed in one piece.

3. A downhole centralizer as claimed in claim 1, wherein the first material has a Young's modulus of between about 550,000 and about 1,000,000 psi (3,793 to 6,896 MPa), and the second material has a Young's modulus of at least about 10,000,000 psi (68,960 MPa).

4. A downhole centralizer as claimed in claim 1, wherein the first material is selected from the group consisting of a polyphthalamide (PPA) optionally having glass reinforcement; a polymer of carbon monoxide and alpha-olefins; an aliphatic polyketone made from co-polymerization of ethylene and carbon monoxide, optionally with propylene; a semi-crystalline thermoplastic material with an alternating olefin—carbon monoxide structure; a nylon material; a polyamide (PA); polyethertherketone; and polytetrafluoroethylene (PTFE).

5. A downhole centralizer as claimed in claim 1, wherein the outermost surface of the tubular body includes a plurality of raised portions.

6. A downhole centralizer as claimed in claim 5, wherein the raised portions are configured as at least one of longitudinally extending blades, longitudinally extending ribs, an array of nipples, and an array of lobes.

7. A downhole centralizer as claimed in claim 5, wherein adjacent raised portions define a flow path therebetween such that fluid flow paths are defined between the opposed ends of the tubular body.

8. A downhole centralizer as claimed in claim 5, wherein the raised portions comprise longitudinal blades, the blades being formed, at least in part, substantially parallel to a longitudinal axis of the tubular body.

9. A downhole centralizer as claimed in claim 6, wherein the blades are formed in at least one of a longitudinal spiral and a longitudinal helical path on the tubular body.

10. A downhole centralizer as claimed in claim 9, wherein adjacent blades at least partly longitudinally overlap along the tubular body.

11. A downhole centralizer as claimed in claim 9, wherein adjacent blades are located such that one end of one blade at one end of the tubular body is at substantially the same circumferential position as one end of an adjacent blade at the other end of the tubular body.

12. A downhole centralizer as claimed in claim 6, wherein each of the blades have an upper spiral portion, a middle substantially straight portion and a lower tapered portion.

13. A downhole centralizer as claimed in claim 1, wherein the metallic material is selected from the group consisting of a bronze alloy, phosphor bronze, lead bronze, zinc, and a zinc alloy.

14. A downhole centralizer as claimed in claim 1, wherein the downhole centralizer includes a reinforcing means comprising at least one of a cage, a mesh, a bar, and a ring.

15. A downhole centralizer as claimed in claim 14, wherein the reinforcing means is made of the second material.

16. A downhole centralizer as claimed in claim 1, wherein at least part of the downhole centralizer is formed from at least one of a casting process, an injection molding process, and a roto-molding process.

17. A downhole centralizer as claimed in claim 1, wherein the at least one first portion is retained relative to the at least one second portion by an interference fit.

18. A downhole centralizer as claimed in claim 1, wherein one of the ends of the tubular member comprises at least one of an abutment surface and a thrust bearing surface.

19. A centralizing apparatus for use in a well-bore, comprising:

a tubular section comprising one of a well-bore casing, a liner, a screen, and a length of production tubing; and at least one downhole centralizer forming one of a well-bore casing centralizer, a liner centralizer, a screen centralizer, and a production tubing centralizer, the at least one downhole centralizer comprising a rigid tubular body configured to be received on the tubular section, in a clearance fit around the tubular section, the tubular body including at least one first portion and at least one second portion, the at least one first portion and the at least one second portion being statically retained relative to one another, the at least one first portion comprising a tubular member having opposed ends and providing at least a portion of an outermost surface of the tubular body, the at least one first portion being substantially formed from a first material, and the at least one second portion comprising a ring member disposed about one of the ends of the tubular member, the at least one second portion being substantially formed from a second material, the first material having a lower Young's modulus than the second material, the first material substantially comprising a thermoplastic polymer and a second material comprising a metallic material, whereby the at least one metallic second portion is configured to cooperate with the tubular section such that the entire downhole centralizer is rotationally and longitudinally movable relative to the tubular section, and whereby the at least one metallic second portion is configured to radially reinforce the one of the ends of the tubular member.

20. A centralizing apparatus as claimed in claim 19, wherein the at least one downhole centralizer is configured to surround the tubular section, such that the tubular section is located within the at least one downhole centralizer.

21. A centralizing apparatus as claimed in claim 19, wherein the at least one downhole centralizer is located longitudinally relative to the tubular section by a stop collar.

22. A method of fixing at least one of a casing and a liner into a well-bore, the method comprising:

locating at least one downhole centralizer on the at least one of the casing and the liner at a desired position with respect thereto, so as to provide a centralizing apparatus, the at least one downhole centralizer comprising a rigid tubular body adapted to be received on the at least one of the casing and the liner, in a clearance fit around the at least one of the casing and the liner, the tubular body including at least one first portion and at least one second portion, the at least one first portion and the at least one second portion being statically retained relative to one another, the at least one first portion comprising a tubular member having opposed ends and providing at least a portion of an outermost surface of the tubular body, the at least one first portion being substantially formed from a first material, and the at least one second portion comprising a ring member disposed about one of the ends of the tubular member, the at least one second portion being substantially formed from a second material, the first material having a lower Young's modulus than the second material, the first material substantially comprising a thermoplastic polymer, and the second material comprising a metallic material, whereby the at least one metallic second portion is configured to cooperate with the at least one of the casing and the liner such that the entire downhole centralizer is rotationally and longitudinally movable relative to the at least one of the casing and the liner, and whereby the at least one metallic second portion is configured to radially reinforce the one of the ends of the tubular member;

placing the centralizing apparatus within the well-bore; and pumping a cement slurry into an annular space between an exterior of the at least one of the casing and the liner, and the well-bore.

23. A method as claimed in claim 22, wherein one of the ends of the tubular member comprises an uppermost end of the tubular body when the centralizing apparatus is placed within the well-bore.

24. A method of gravel packing a well, the method comprising:

locating at least one downhole centralizer on a screen so as to provide a centralizing apparatus, the at least one downhole centralizer comprising a rigid tubular body adapted to be received on the screen, in a clearance fit around the screen, the tubular body including at least one first portion and at least one second portion, the at least one first portion and the at least one second portion being statically retained relative to one another, the at least one first portion comprising a tubular member having opposed ends and providing at least a portion of an outermost surface of the tubular body, the at least one first portion being substantially formed from a first material, and the at least one second portion comprising a ring member disposed about one of the ends of the tubular member, the at least one second portion being substantially formed from a second material, the first material having a lower Young's modulus than the second material, the first material substantially comprising a thermoplastic polymer, and the second material comprising a metallic material, whereby the at least one metallic second portion is configured to cooperate with the screen such that the entire downhole centralizer is rotationally and longitudinally movable relative to the screen, and whereby the at least one metallic second portion is configured to radially reinforce the one of the ends of the tubular member;

placing the centralizing apparatus within at least one of a well-bore and a perforated casing; and placing at least one of gravel and sand into an annular space between an exterior of the screen and the at least one of the well-bore and the perforated casing.

25. A method of completing a well, the method comprising:

locating at least one downhole centralizer on a length of production tubing, at a desired position with respect thereto, so as to provide a centralizing apparatus, the at least one downhole centralizer comprising a rigid tubular body adapted to be received on the tubing, in a clearance fit around the tubing, the tubular body including at least one first portion and at least one second portion, the at least one first portion and the at least one second portion being statically retained relative to one another, the at least one first portion comprising a tubular member having opposed ends and providing at least a portion of an outermost surface of the tubular body, the at least one first portion being substantially formed from a first material, and the at least one second portion comprising a ring member disposed about one of the ends of the tubular member, the at least one second portion being substantially formed from a second material, the first material having a lower Young's modulus than the second material, the first material substantially comprising a thermoplastic polymer, and the second material comprising a metallic material, whereby the at least one metallic second portion is configured to cooperate with the tubing such that the entire downhole centralizer is rotationally and longitudinally movable relative to the tubing, and whereby the at least one metallic second portion is configured to radially reinforce the one of the ends of the tubular member; and placing the centralizing apparatus within at least one of a cased well-bore and a lined well-bore.

26. A method as claimed in claim 25, further comprising securing a bottom end of the length of the production tubing with a packer so as to seal the tubing to at least one of a casing and a liner.

27. A downhole centralizer forming one of a casing centralizer, a liner, a screen centralizer, and a production tubing centralizer, the downhole centralizer comprising:

a rigid tubular body adapted to be received on a downhole tubular element, in a clearance fit around the downhole tubular element, the tubular body including at least one first portion and at least one second portion, the at least one first portion and the at least one second portion being statically retained relative to one another, the at least one first portion comprising a tubular member having opposed ends and providing at least a portion of an outermost surface of the tubular body, the at least one first portion being substantially formed from a first material, and the at least one second portion comprising a discrete additional tubular member providing at least a portion of an innermost surface of the tubular body, the at least one second portion being substantially formed from a second material, the first material having a lower Young's modulus than the second material, wherein at least a portion of the tubular member is radially thicker than the discrete additional tubular member, the first material substantially comprising a thermoplastic polymer and the second material comprising a metallic material, whereby the at least one metallic second portion is configured to cooperate with the downhole tubular element such that the entire downhole centralizer is rotationally and longitudinally movable relative to the downhole tubular element, and whereby the at least one metallic second portion is configured to radially reinforce the tubular body.

28. A downhole centralizer as claimed in claim 27, wherein at least one of the at least one first portion and the at least one second portion is circumferentially formed in one piece.

29. A downhole centralizer as claimed in claim 27, wherein the first material has a Young's modulus of between about 550,000 and about 1,000,000 psi (3,793 to 6,896 MPa), and the second material has a Young's modulus of at least about 10,000,000 psi (68,960 MPa).

30. A downhole centralizer as claimed in claim 27, wherein the first material is selected from the group consisting of a polyphthalamide (PPA) optionally having glass reinforcement; a polymer of carbon monoxide and alpha-olefins; an aliphatic polyketone made from co-polymerization of ethylene and carbon monoxide, optionally with propylene; a semi-crystalline thermoplastic material with an alternating olefin—carbon monoxide structure; a nylon material; a polyamide (PA); polyetheretherketone; and polytetrafluoroethylene (PTFE).

31. A downhole centralizer as claimed in claim 27, wherein the outermost surface of the tubular body includes a plurality of raised portions.

32. A downhole centralizer as claimed in claim 31, wherein the raised portions are configured as at least one of longitudinally extending blades, longitudinally extending ribs, an array of nipples, and an array of lobes.

33. A downhole centralizer as claimed in claim 31, wherein adjacent raised portions define a flow path therebetween such that fluid flow paths are defined between the opposed ends of the tubular body.

34. A downhole centralizer as claimed in claim 31, wherein the raised portions comprise longitudinal blades, the blades being formed, at least in part, substantially parallel to a longitudinal axis of the tubular body.

35. A downhole centralizer as claimed in claim 32, wherein the blades are formed in at least one of a longitudinal spiral and a longitudinal helical path on the tubular body.

36. A downhole centralizer as claimed in claim 35, wherein adjacent blades at least partly longitudinally overlap along the tubular body.

37. A downhole centralizer as claimed in claim 35, wherein adjacent blades are located such that one end of one blade at one end of the tubular body is at substantially the same circumferential position as one end of an adjacent blade at the other end of the tubular body.

38. A downhole centralizer as claimed in claim 32, wherein each of the blades have an upper spiral portion, a middle substantially straight portion and a lower tapered portion.

39. A downhole centralizer as claimed in claim 27, wherein the metallic material is selected from the group consisting a bronze alloy, phosphor bronze, lead bronze, zinc, and a zinc alloy.

40. A downhole centralizer as claimed in claim 27, wherein the downhole centralizer includes a reinforcing means comprising at least one of a cage, a mesh, a bar, and a ring.

41. A downhole centralizer as claimed in claim 40, wherein the reinforcing means is made of the second material.

42. A downhole centralizer as claimed in claim 27, wherein at least part of the downhole centralizer is formed from at least one of a casting process, an injection molding process, and a roto-molding process.

43. A downhole centralizer as claimed in claim 27, wherein the at least one first portion is retained relative to the at least one second portion by an interference fit.

44. A centralizing apparatus for use in a well-bore, comprising:

a tubular section comprising one of a well-bore casing, a liner centralizer, a screen, and a length of production tubing; and at least one downhole centralizer forming one of a well-bore casing centralizer, a liner centralizer, a screen centralizer, and a production tubing centralizer, the at least one downhole centralizer comprising a rigid tubular body configured to be received on the tubular section, in a clearance fit around the tubular section, the tubular body including at least one first portion and at least one second portion, the at least one first portion and the at least one second portion being statically retained relative to one another, the at least one first portion comprising a tubular member having opposed ends and providing at least a portion of an outermost surface of the tubular body, the at least one first portion being substantially formed from a first material, and the at least one second portion comprising a discrete additional tubular member providing at least a portion of an innermost surface of the tubular body, the at least one second portion being substantially formed from a second material, the first material having a lower Young's modulus than the second material, wherein at least a portion of the tubular member is radially thicker than the discrete additional tubular member, the first material substantially comprising a thermoplastic polymer, and the second material comprising a metallic material, whereby the at least one metallic second portion is configured to cooperate with the tubular section such that the entire downhole centraliser is rotationally and longitudinally movable relative to the tubular section, and whereby the at least one metallic second portion is configured to radially reinforce the tubular body.

45. A centralizing apparatus as claimed in claim 44, wherein the at least one downhole centralizer is configured to surround the tubular section, such that the tubular section is located within the at least one downhole centralizer.

46. A centralizing apparatus as claimed in claim 44, wherein the at least one downhole centralizer is located longitudinally relative to the tubular section by a stop collar.

47. A method of fixing at least one of a casing and a liner into a well-bore, the method comprising:

locating at least one downhole centralizer on the at least one of the casing and the liner, at a desired position with respect thereto, so as to provide a centralizing apparatus, the at least one downhole centralizer comprising a rigid tubular body adapted to be received on the at least one of the casing and the liner, in a clearance fit around the at least one of the casing and the liner, the tubular body including at least one first portion and at least one second portion, the at least one first portion and the at least one second portion being statically retained relative to one another, the at least one first portion comprising a tubular member having opposed ends and providing at least a portion of an outermost surface of the tubular body, the at least one first portion being substantially formed from a first material, and the at least one second portion comprising a discrete additional tubular member providing at least a portion of an innermost surface of the tubular body, the at least one second portion being substantially formed from a second material, the first material having a lower Young's modulus than the second material, wherein at least a portion of the tubular member is radially thicker than the discrete additional tubular member, the first material substantially comprising a thermoplastic polymer, and the second material comprising a metallic material, whereby the at least one metallic second portion is configured to cooperate with the at least one of the casing and the liner such that the entire downhole centralizer is rotationally and longitudinally movable relative to the at least one of the casing and the liner, and whereby the at least one metallic second portion is configured to radially reinforce the tubular body;

placing the centralizing apparatus within the well-bore; and pumping a cement slurry into an annular space between an exterior of the at least one of the casing and the liner, and the well-bore.

48. A method of gravel packing a well, the method comprising:

locating at least one downhole centralizer on a screen so as to provide a centralizing apparatus, the at least one downhole centralizer comprising a rigid tubular body adapted to be received on the screen, in a clearance fit around the screen, the tubular body including at least one first portion and at least one second portion, the at least one first portion and the at least one second portion being statically retained relative to one another, the at least one first portion comprising a tubular member having opposed ends and providing at least a portion of an outermost surface of the tubular body, the at least one first portion being substantially formed from a first material, and the at least one second portion comprising a discrete additional tubular member providing at least a portion of an innermost surface of the tubular body, the at least one second portion being substantially formed from a second material, the first material having a lower Young's modulus than the second material, wherein at least a portion of the tubular member is radially thicker than the discrete additional tubular member, the first material substantially comprising a thermoplastic polymer; and the second material comprising a metallic material, whereby the at least one metallic second portion is configured to cooperate with the screen such that the entire downhole centralizer is rotationally and longitudinally movable relative to the screen, and whereby the at least one metallic second portion is configured to radially reinforce the tubular body;

placing the centralizing apparatus within at least one of a well-bore and a perforated casing; and placing at least one of gravel and sand into an annular space between an exterior of the screen and the at least one of the well-bore and the perforated casing.

49. A method of completing a well, the method comprising:

locating at least one downhole centralizer on a length of production tubing, at a desired position with respect thereto, so as to provide a centralizing apparatus, the at least one downhole centralizer comprising a rigid tubular body adapted to be received on the tubing, in a clearance fit around the tubing, the tubular body including at least one first portion and at least one second portion, the at least one first portion and the at least one second portion being statically retained relative to one another, the at least one first portion comprising a tubular member having opposed ends and providing at least a portion of an outermost surface of the tubular body, the at least one first portion being substantially formed from a first material, and the at least one second portion comprising a discrete additional tubular member providing at least a portion of an innermost surface of the tubular body, the at least one second portion being substantially formed from a second material, the first material having a lower Young's modulus than the second material, wherein at least a portion of the tubular member is radially thicker than the discrete additional tubular member, the first material substantially comprising a thermoplastic polymer, and the second material comprising a metallic material, whereby the at least one metallic second portion is configured to cooperate with the tubing such that the entire downhole centralizer is rotationally and longitudinally movable relative to the tubing, and whereby the at least one metallic second portion is configured to radially reinforce the tubular body; and placing the centralizing apparatus within at least one of a cased well-bore and a lined well-bore.

50. A method as claimed in claim 49, further comprising securing a bottom end of the length of the production tubing with a packer so as to seal the tubing to at least one of a casing and a liner.

* * * * *